United States Patent [19]

Marshall

[11] 4,297,079

[45] Oct. 27, 1981

[54] VARIABLE PITCH MARINE PROPELLER

[75] Inventor: Don J. Marshall, Churchton, Md.

[73] Assignee: Goodall SemiMetallic Hose & Mfg. Co., Chestertown, Md.

[21] Appl. No.: 168,034

[22] Filed: Jul. 14, 1980

[51] Int. Cl.[3] ..... B63H 1/22

[52] U.S. Cl. ..... 416/140; 416/107; 416/143

[58] Field of Search ..... 416/142 A, 143, 140 R, 416/107

[56] References Cited

U.S. PATENT DOCUMENTS

| | | | |
|---|---|---|---|
| 2,608,257 | 8/1952 | Godfrey | 416/142 A |
| 2,638,171 | 5/1953 | Foss | 416/140 X |
| 2,885,012 | 5/1959 | Heintzelman | 416/143 |
| 3,358,773 | 12/1967 | Oldberg | 416/143 X |
| 3,565,544 | 2/1971 | Marshall | 416/143 X |

*Primary Examiner*—Everette A. Powell, Jr.
*Attorney, Agent, or Firm*—William J. Dick

[57] ABSTRACT

A variable pitch marine propeller having a plurality of circumferentially spaced apart blades mounted on axles at the root portion of the blades in a hub to permit independent movement of each of the blades about an axis of rotation substantially parallel to the axis of the hub between a first nested position adjacent the hub and a second extended position. Each of the blades includes leading and trailing striking surfaces or root segments on the root portion of the blades which are hub engageable upon initial rotation of the blade in either direction. Intermediate the leading and trailing segments of the blades are positioned cushioning means which may be mounted in either the hub or the blade root segments for inhibiting the shock of engagement of the blades and the hub upon initial start up of rotation of the hub or upon a sudden reversal of rotation of the hub. The cushioning means includes water entrance and graduated exit means with means to capture water therein to act as a shock absorber for the blades against the hub.

10 Claims, 12 Drawing Figures

FIG. 3
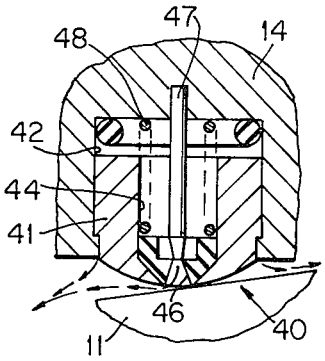
FIG. 3A
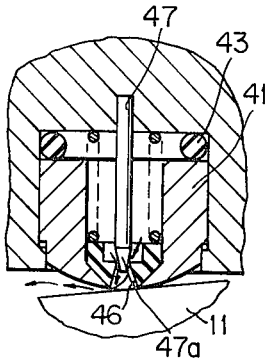
FIG. 3B
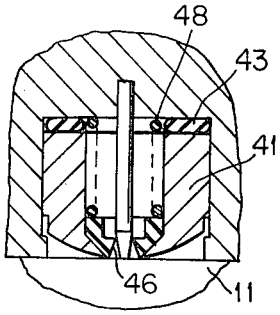
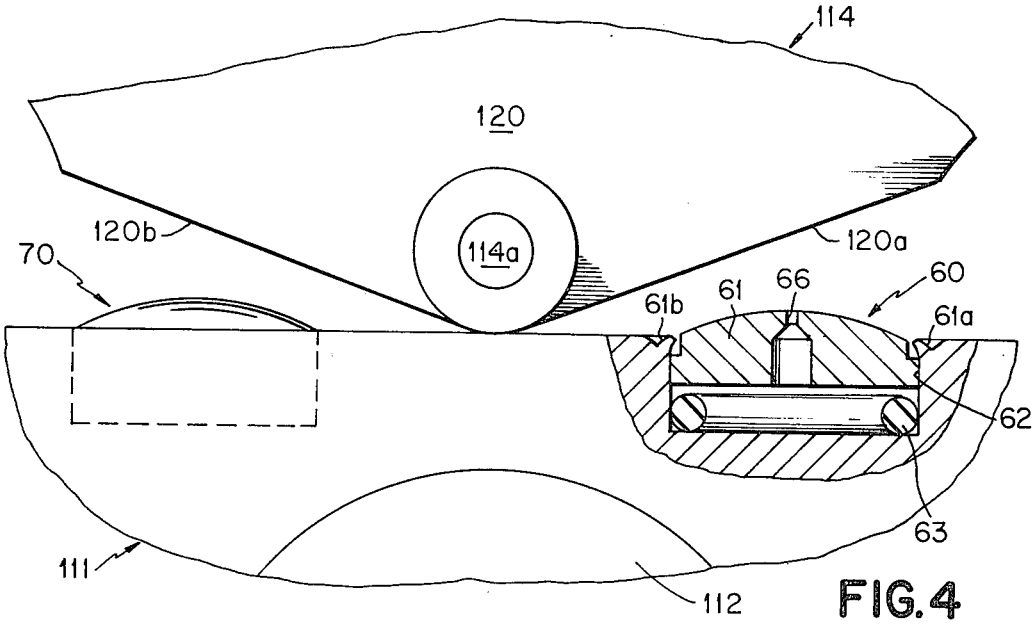
FIG. 4
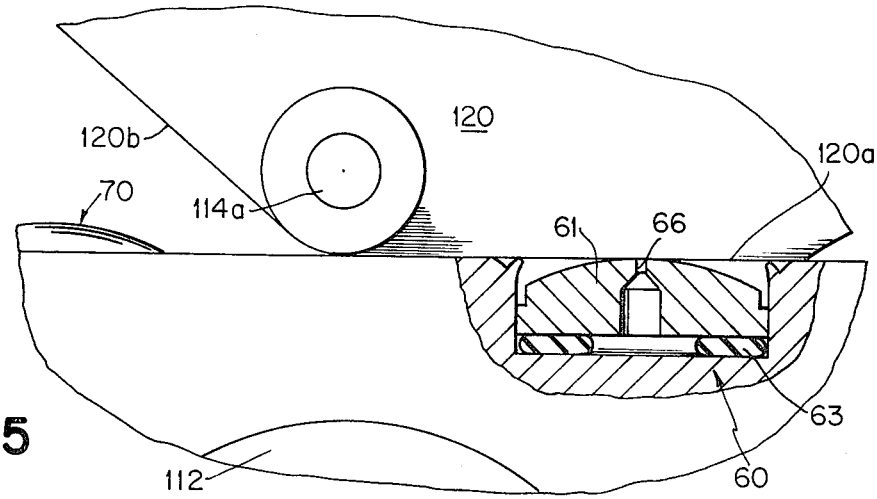
FIG. 5

VARIABLE PITCH MARINE PROPELLER

SUMMARY OF THE INVENTION AND STATE OF THE PRIOR ART

The present invention relates to marine propellers, and more specifically an improved variable pitch marine propeller with improved cushioning means which utilizes entrapped water to aid in shock absorbing and allows water to be emitted from the shock absorber gradually to thereby inhibit excessive shock load upon both the blades, hub and drive train.

In U.S. Pat. No. 3,565,544, issued on Feb. 23, 1971 to the present inventor is disclosed a variable pitch marine propeller which automatically varies both the pitch and diameter of the propeller solely dependent upon the thrust requirement of the driven vessel under varying operating conditions. In the aforementioned patent, specifically at column 3, lines 60–63 and column 5, lines 31–44, the hub of the propeller is described as being coated with an elastomeric material which may be employed to limit drive train shock loads during starting and reversing operations. However, it has been found that while such resilient material is effective under light to moderate and infrequent loading, it is desirable to provide a more advanced type cushioning or shock absorbing means to prevent, under severe load demands, such as sudden full power from dead stop, or full reverse thrust from a forward condition, shocks on the hub and blades which might lead to blade and/or hub fracture in high horsepower commercial vessel service. This is the principle object of the present invention.

For a full disclosure of the manner in which the variable pitch propeller operates, and in which the present invention is to be applied, U.S. Pat. No. 3,565,544 is herein incorporated by reference.

It is a further object of the present invention to provide in a variable pitch marine propeller, water aided cushioning means which act as a shock absorber for the blades and the hub upon commencement of rotation of the hub either in a forward or reverse direction.

It is still a further object of the present invention to provide one embodiment of such cushioning means in a variable pitch marine propeller which will permit of automatic clearing of any fouling in the cushioning means due to barnacles, dirt and the like.

Other objects and a more complete understanding of the invention may be had by referring to the following specification and claims taken in conjunction with the accompanying drawings.

DESCRIPTION OF THE DRAWINGS

FIGS. 3–3*b* are fragmentary sectional views taken in side elevation illustrating the cushioning means of the present invention in operation;

FIG. 4 is an enlarged fragmentary sectional view of another cushioning means constructed in accordance with the present invention in the hub of the propeller and shown in the first position;

FIG. 5 illustrates the cushioning means of FIG. 4 in a second position;

Figure 1:
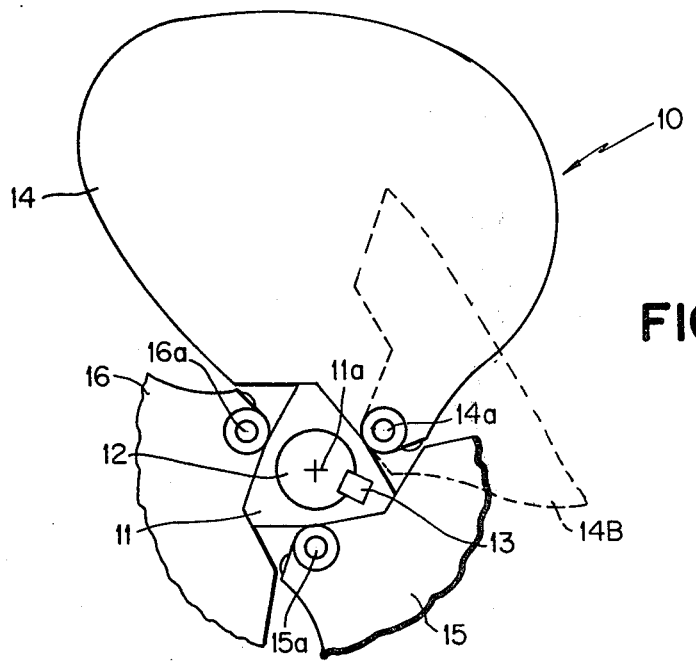
FIG. 1 is a fragmentary side elevational view of a variable pitch marine propeller incorporating cushioning apparatus constructed in accordance with the present invention.

Referring now to the drawing, and especially FIG. 1 thereof, a variable pitch marine propeller 10 including novel apparatus constructed in accordance with the present invention, is illustrated therein. The propeller 10 includes a hub portion 11 adapted to be mounted on a drive shaft 12 of an engine (not shown) as by a key or the like 13. Thus the hub 11 has a central axis of rotation 11*a* for coaxial mounting on the rotatable shaft 12. A plurality of circumferentially spaced apart blades 14, 15 and 16 are mounted on the hub as by longitudinally extending axles 14*a*–16*a* respectively at the root portion of the blades to permit independent movement of each of the blades about an axis of rotation substantially parallel to the axis 11*a* of the hub between a first nested position, illustrated in full lines in FIG. 1, adjacent the hub 11 and a second extended position such as shown by the dotted line 14*b* of the blade 14. Each of the blades 14–16 includes leading and trailing segments 20*a* and 20*b* respectively in the root portion 20 of the blades which segments are hub engageable upon initial rotation of the blades in either direction.

Figure 2:
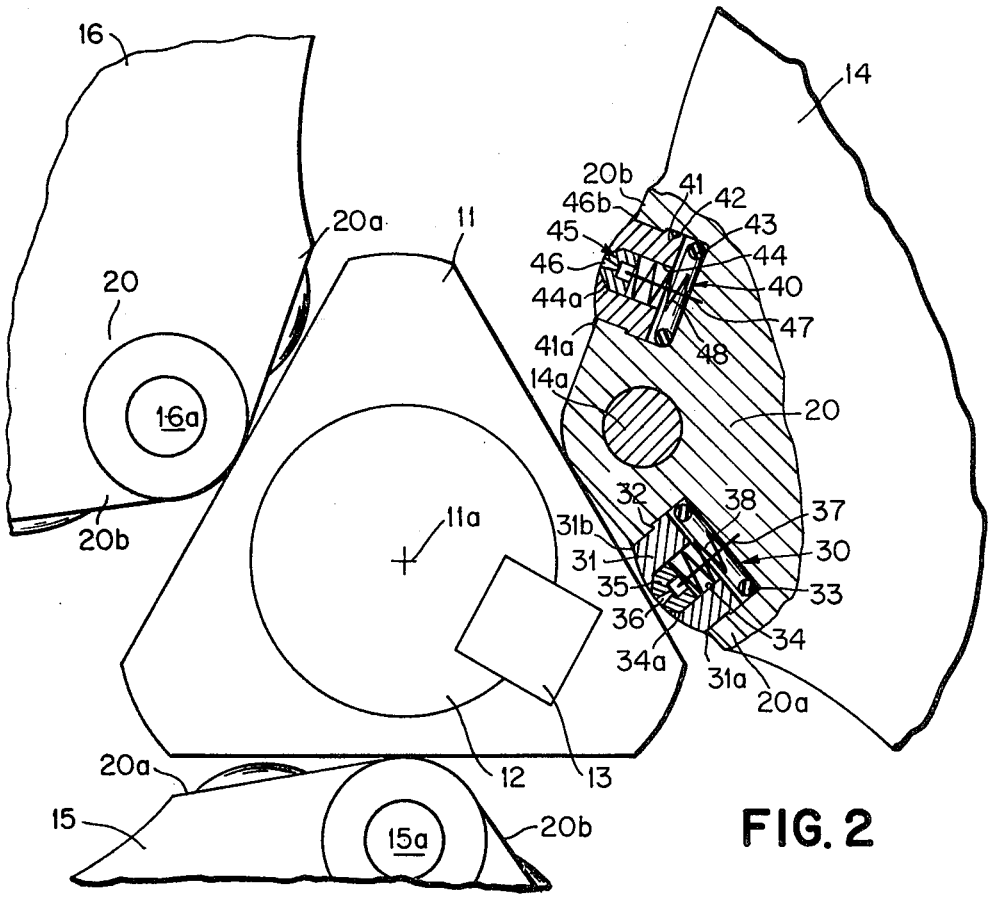
FIG. 2 is an enlarged fragmentary sectional view of a portion of the apparatus illustrated in FIG. 1 with portions broken away to better illustrate one form of cushioning means.

In accordance with the invention, in order to inhibit excessive shock and momentum load upon the blades when high power levels are applied to the shaft from an at rest condition to a high speed condition, or alternatively when the shaft is suddenly rotated in the opposite direction as when backing down, cushioning means 30 and 40 having at least a portion thereof intermediate the leading and trailing segments 20*a* and 20*b* of the blades and the hub 11 and mounted in one of the blades and hub tend to inhibit the shock of engagement of the blades and the hub. To this end, and referring now to FIG. 2, each of the cushioning means in the preferred form of the embodiment illustrated in FIG. 2, comprises a piston 31, 41 mounted in a cylinder or chamber like recess 32, 42, for reciprocation therein. As illustrated, the chambers or recesses 32, 42 include sealing means, in the present instance O-rings or the like 33, 43 which underlie the pistons 31, 41 and are spaced from the sealing means or O-rings 33, 43 when the pistons are not engaged by, in the present instance, the hub 11. Thus the position of the pistons 31 and 41, during normal operation of the propeller is as shown in FIG. 2 with the upper portion of the piston projecting slightly above the plane of the leading and trailing segments 20*a*, 20*b* respectively, in order, as will be more fully explained hereinafter, to engage the surface of the hub 11 prior to engagement of the blade segments 20*a*, 20*b* of the root portion. The pistons 31 and 41 are held in place so that their stroke is limited as by stakes or the like at 31*a*, 31*b*, 41*a*, 41*b*, each of the pistons 31 and 41 including a bore 34, 44 which tapers at its upper end as at 34*a*, 44*a* to receive a plug or the like 35, 45 therein, the plug including a central aperture 36, 46 therein which is in line with a projection, in the present instance a pin 37, 47 in the root portion of the blade, the pistons 31, 41 being biased away from the O-rings as by compression springs 38, 48 respectively.

The operation of the cushioning means 30 and 40 is best illustrated in FIGS. 3–3*b*. Assuming for example that the propeller is at rest and power is applied to the drive shaft 12, and thus the hub 11 in order to effect rotation of the propeller, as the hub 12 starts rotating, the chamber like recess 42 in the trailing segment 20*b* which, because the propeller is in water is filled with water, will tend to move downwardly (FIG. 2) against the hub 11 tending to move the piston 41 inwardly in the chamber like recess 42. As this occurs, the piston 41 displaces water within the bore 44, compressing the spring 48 and squeezing water out through the aperture 46 and out of the sides intermediate the piston 41 and the interior side walls of the chamber 42, as illustrated by the arrows 51 in the drawing of FIG. 3. As further engagement of the hub 11 against the piston 41 occurs, such as illustrated in FIG. 3*a*, the piston 41 engages the sealing means or O-ring 43 trapping water interiorly of the O-ring and limiting the egress of the water from the chamber to the aperture 46. The depression of the piston 41 also causes the aperture 46 to be cleared of any debris, or barnacles and the like (if the blade has been sitting in the water for any length of time) while still permitting some water to egress from the aperture around the tip 47*a* of the rod. As the piston 41 is depressed still further, the seal 43 is squeezed, and the hub surface of the hub 11 engages the upper portion of the piston sealing the aperture 46 (limiting water egress to leakage) effecting a cushioning action thereby inhibiting the shock load which would normally occur from a start up position to a full load position and giving a hydraulic shock absorber action to the propeller. It should be recognized, that if the hub rotation was reversed, for example the application of power from either a standing start or from a go-ahead to full reverse, the cushioning means 30 would act and operate in the same manner as the cushioning means 40 heretofore described relative to FIGS. 3–3*b*.

It should be noted that the embodiment of the invention illustrated in FIGS. 2 and 3 incorporates the cushioning means within the blades of the propeller, but the cushioning means could be just as well disposed within the hub 11 of the propeller 10 intermediate the leading and trailing segments 20*a*, 20*b* of the root portion 20 of each of the blades as long as the pistons in the chambers have a rest position above the plane of the hub so that engagement of the hub 11 with the blade root portion (whether it be leading or trailing segment) is preceeded by the aforementioned and heretofore described action of the cushioning means to inhibit shock loading. The ability to place the cushioning means in either the blades or propeller hub depends upon the quantity of material in the hub or propeller and the room to place the cushioning means in one or the other.

In the embodiment of the invention illustrated in FIGS. 4 and 5, the cushioning means 60 and 70 are placed in the hub 111 on opposite sides of an imaginary line passing through the axle 114*a* of a blade 114 and the shaft 112 center for engagement with the leading segment or striking surface 120*a* or trailing segment or striking surface 120*b* of a root portion 120. In the embodiment of the invention illustrated in FIGS. 4 and 5, a piston 61 (inasmuch as both cushioning means 60 and 70 are identical, and only cushioning means 60 is shown in detail, all parts of 70 are identical to the cushioning means 60) is free to reciprocate in a chamber like recess or cylinder 62. The piston 61 includes an aperture 66 therein, the upper portion of the piston being elevated, in its at rest position (non-engageable position with the blade root segment 120*a*) above the surface of the hub 111. Immediately below the piston 61 in the chamber like recess 62 is a seal 63 which, in the position illustrated in FIG. 4, is not engaged by the lower surface of the piston 61, but operates in the identical way that the piston sealing means 43 and 33 operated with respect to FIGS. 2 and 3. In a similar manner, as heretofore described relative to FIGS. 2 and 3, the piston 61 may be held from ejection from the cylindrical recess chamber 62 as by, for example, stakes such as illustrated at 61*a*, 61*b*, or may be held by any other convenient means such as a snap ring etc.

In operation, for example upon sudden reversal of the hub 111, the blade will tend to swing about the axle 114*a* causing the leading segment portion 120*a* to engage the upper surface of the piston 61 tending to depress the piston downwardly until the piston engages the seal 63 thereby inhibiting water exit from around the piston 61 and trapping water intermediate the central portion of the seal. This will restrict the water exit to the orifice 66, and once the orifice 66 is engaged as by the segment 120*a* (as shown in FIG. 5) further water discharge from the aperture 66 is limited to leakage. Thus in this manner the piston 61, in conjunction with the seal 63, aperture 66 and water entrapped within the chamber 62 intermediate the seal 63 and aperture 66 acts as a shock absorber inhibiting excessive loading shock force which may tend to fracture either the hub or the blades or both.

Figure 7:
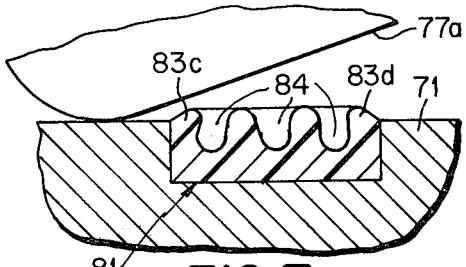
FIG. 7 is a fragmentary sectional view taken along lines 7—7 of FIG. 6.
Figure 8:
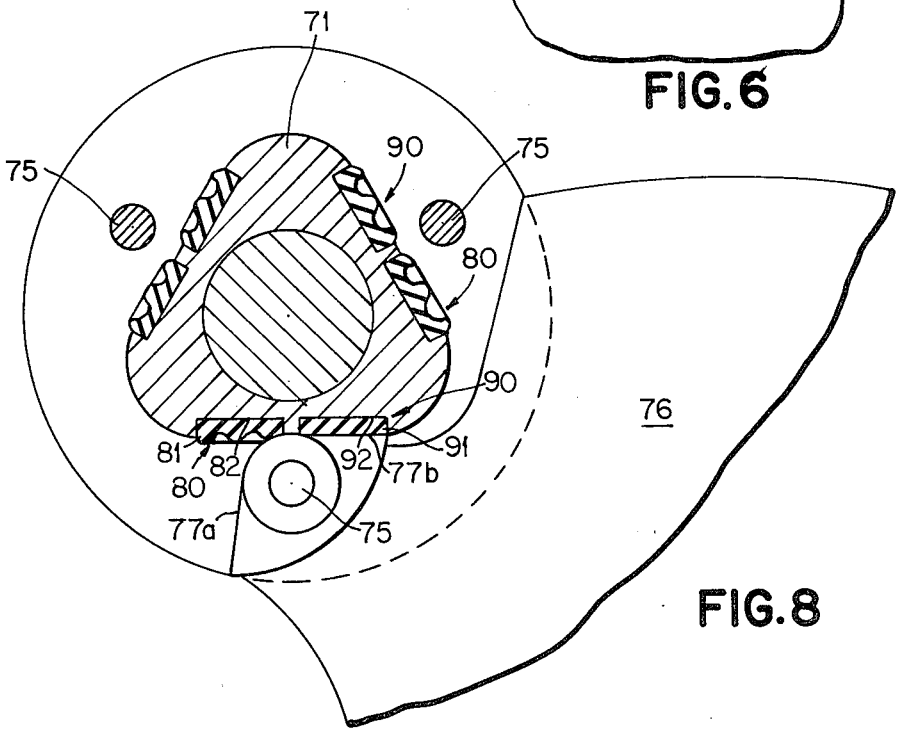
FIG. 8 is an enlarged side elevational view taken in section of the apparatus of FIGS. 6 and 7 illustrating their position and operation.

Under light usage, i.e., small props and relatively low horsepower, the embodiments of FIGS. 6–10 may be employed. For example, and referring first to FIGS. 6 and 8, the cushioning means 80 and 90 may be placed on opposite sides of an imaginary line passing through the axle 75 of the blades 76 and the center of the hub 71 (as shown in FIG. 8) or they may be placed in the leading and trailing segments 77*a*, 77*b* of the root portion of the blades 76. In this embodiment of the invention, recesses 81, 91, are disposed on opposite sides of the root portion of each of the blades and in the hub 71, the cushioning means 80, 90 comprising a resilient member 81, 91 mounted in recesses 82, 92, each of the resilient members including a plurality of ribs 83 which project above either the hub or blade root leading in trailing segments such as illustrated in FIG. 7 with cavities 84 disposed intermediate the ribs for purposes which will be explained hereinafter. The outboard ribs i.e. ribs 83*a* and 83*b* include tip portions thereof as at 83*c* and 83*d* which project inwardly so that upon impact between the blade root portion, leading or trailing segment and the resilient ribs, the resilient ribs on the leading and trailing edges will not be severed by the force of impact. In operation, upon blade reversal or quick start up action, the leading segment or trailing segment, such as the leading segment 77*a* and the rib portion of the blade 76 will impinge upon first the rib 83*c* tending to deflect the rib inwardly, squeezing the rib 83 over the cavity 84 (which is in the water) trapping water in the cavity 84 due to the deflecting action of the resilient rib and the leading portion 77*a* overlying the cavity in engagement with the remaining ribs 83. This trapping action will cause further deflection of the resilient member until the surface 77*a* contacts the metal of the hub 71, but the shock absorbing action of both the resilient member coupled with the entrapped water will aid in the shock absorbing action of the cushioning member.

Figure 10:
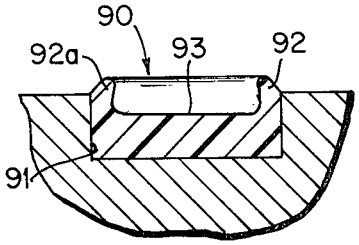
FIG. 10 is a fragmentary sectional view taken along lines 10—10 of FIG. 8.
Figure 9:
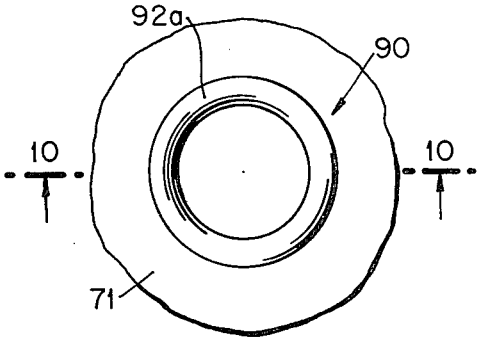
FIG. 9 is still another embodiment of a cushioning means constructed in accordance with the present invention, taken in plan and of a segment of a blade or hub.
Figure 6:
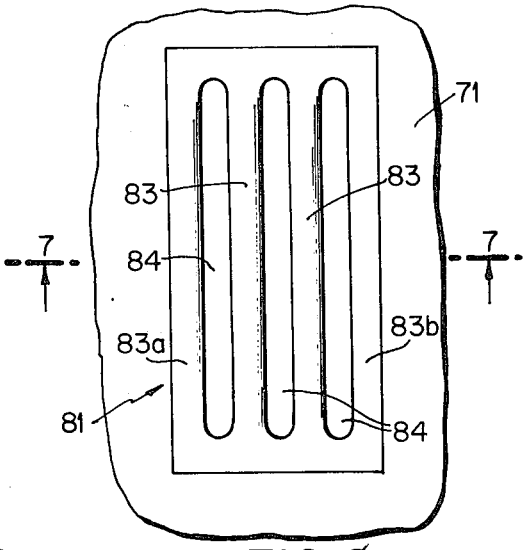
FIG. 6 is an enlarged plan view of a fragment of another cushioning means in a variable pitch marine propeller, constructed in accordance with the present invention and which may be employed for lighter use.

In the embodiment illustrated in FIGS. 9 and 10, a plurality of cushioning members 90 composed of a ring like resilient members such as ring 91 is illustrated. The ring like resilient members 91, as before, may be disposed in the leading and trailing segments of the blade, or may be disposed in the hub portion of the propeller opposite the segments. As illustrated, the ring like resilient portion includes a circumferentially extending rib 92, the tip 92*a* of which projects radially inward to prevent a cutting action from occurring upon leading or trailing blade segment impact upon the ribs. Moreover, centrally located in the ring like resilient member, is a central cavity 93 which like the cavities 84 of the embodiment illustrated in FIGS. 6–8, acts to trap water which aids in the cushioning operation to inhibit detrimental shock loading of the propeller hub and blade system.

It is obvious that the latter two embodiments of the invention operate in a manner similar to that described relative to FIGS. 1–5 inasmuch as water is trapped during contact of the blade and hub stop surfaces in conjunction with one another. Moreover while such embodiments will withstand moderate forces, the embodiments illustrated in FIGS. 2–5 are to be preferred for heavy loads.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed:

What is claimed is:

1. A variable pitch marine propeller comprising:

a hub having a central axis of rotation for coaxial mounting on a rotatable shaft;

a plurality of circumferentially spaced apart blades pivotally mounted on axles on said hub through the root portion of said blades to permit independent movement of each of said blades about an axis of rotation substantially parallel to the axis of said hub between a first nested position adjacent said hub and a second extended position;

each of said blades including leading and trailing segments in said root portion of said blades which are hub engageable depending upon the direction of initial rotation of said blades;

cushioning means having at least a portion thereof intermediate said leading and trailing segments of said blades and said hub and mounted in one of said blades and hub for inhibiting the shock of engagement of said blades and said hub;

said cushioning means including water entrance and exit means and means to capture water therein to act as a shock absorber for said blades and hub upon commencement of rotation of said hub.

2. A variable pitch marine propeller in accordance with claim 1 wherein said cushioning means comprises a pair of chamber like recesses for each of said blades on opposite sides of said axles and in one of said blades and hub;

piston means mounted in each of said recesses projecting intermediate said blade and hub;

and sealing means interiorally of said recesses underlying said piston, said sealing means spaced from said piston but in sealing engagement with said piston upon engagement of said other of said blades and hub, said engagement effecting depression of said piston against said sealing means to trap water between said piston and said sealing means.

3. A variable pitch marine propeller in accordance with claim 2 including an aperture in said piston extending through said piston to said sealing means to allow said entrance and egress of water from said recess, said aperture being positioned to be substantially sealed by the other of said leading and trailing segments of said blade and hub upon commencement of rotation of said hub and engagement of said sealing means with said piston.

4. A variable pitch marine propeller in accordance with claims 2 or 3 including biasing means for biasing said piston away from said sealing means outwardly from said recess and to space the sealing means from said piston.

5. A variable pitch marine propeller in accordance with claim 4 including a projection in said recess extending upwardly into said aperture for clearing the aperture upon depression of said piston due to such engagement and forcing said projection into said aperture.

6. A variable pitch marine propeller in accordance with claim 1 including recesses on opposite sides of said axle of each of said blades and in said hub, said cushioning means comprising a resilient member in said recesses, said resilient member including a plurality of spaced apart ribs with cavities therebetween, said ribs projecting above either the hub or blade root leading and trailing segment, and dimensioned to trap water intermediate the ribs in said cavities upon engagement between the leading and trailing segments and the hub due to deflection of the ribs over said cavities and engagement of the hub thereagainst.

7. A variable pitch marine propeller in accordance with claim 6 wherein said peripheral outboard ribs include radially inwardly projecting tip portions to inhibit cutting of said outboard ribs upon engagement of said segment and hub.

8. A variable pitch marine propeller in accordance with claim 1 including recesses on opposite sides of said axle of each of said blades and in said hub, said cushioning means comprising a resilient member having an outwardly projecting, circumferentially extending rib portion and a recessed pocket like portion in said member interiorally of said rib whereby upon deflection of said rib by engagement of said rib by one of said blade, water is trapped in said pocket by said rib and blade overlying said pocket.

9. A variable pitch marine propeller in accordance with claim 8 wherein said rib is inclined radially inward to inhibit cutting thereof upon engagement of said blade against said hub.

10. A variable pitch marine propeller in accordance with claims 6 or 7 or 8 or 9 wherein said recesses are disposed in the leading and trailing segments of each of said blades.

* * * * *